US005673656A

United States Patent [19]

Knob

[11] Patent Number: 5,673,656

[45] Date of Patent: Oct. 7, 1997

[54] CYLINDER HEAD FOR A FOUR STROKE COMBUSTION ENGINE

[75] Inventor: Vaclav Knob, Praha, Czech Rep.

[73] Assignee: Kalivoda Engineering, Czech Rep.

[21] Appl. No.: 637,730

[22] PCT Filed: Oct. 17, 1994

[86] PCT No.: PCT/CZ94/00024

§ 371 Date: Apr. 26, 1996

§ 102(e) Date: Apr. 26, 1996

[87] PCT Pub. No.: WO95/12058

PCT Pub. Date: May 4, 1995

[30] Foreign Application Priority Data

Oct. 27, 1993 [CZ] Czech Rep. ..... 2295-93

[51] Int. Cl.[6] ..... F01L 1/44; F01L 3/20

[52] U.S. Cl. ..... 123/79 R

[58] Field of Search ..... 123/79 R, 79 A, 123/190.2, 190.8

[56] References Cited

U.S. PATENT DOCUMENTS

| | | | |
|---|---|---|---|
| 2,107,389 | 2/1938 | Price et al. | 123/190.8 |
| 2,222,730 | 11/1940 | Wallgren . | |
| 2,336,756 | 12/1943 | Smith | 123/79 R |
| 4,503,817 | 3/1985 | Klomp et al. | 123/79 R |
| 5,020,486 | 6/1991 | Unger | 123/79 R |
| 5,168,843 | 12/1992 | Franks . | |
| 5,331,930 | 7/1994 | McWhorter | 123/79 R |
| 5,398,647 | 3/1995 | Rivera | 123/79 R |

FOREIGN PATENT DOCUMENTS

| | | | |
|---|---|---|---|
| 514.546 | 3/1921 | France . | |
| 871.854 | 5/1942 | France . | |
| 0002457 | of 1906 | United Kingdom | 123/79 R |
| 230644 | 3/1925 | United Kingdom . | |
| 2203192 | 10/1988 | United Kingdom . | |

*Primary Examiner*—Marguerite McMahon

*Attorney, Agent, or Firm*—Burns, Doane, Swecker & Mathis, L.L.P.

[57] ABSTRACT

A cylinder head for a four-stroke combustion engine includes at least one inlet conduit having a valve and/or slide valve and at least one exhaust conduit situated in the cylinder head. The inlet conduit and the exhaust conduit connect into a single main conduit. The main conduit has an orifice having the shape of an annulus, the axis of which is aligned with the main axis of the cylinder. The orifice of the main conduit is provided with an interior valve seat and an exterior valve seat, on which, in the closed position, is seated a ring-shaped plate of the sole lifting valve. The lifting valve has at least one stem. The exhaust conduit of the cylinder head is directly interconnected to the exhaust branch and includes no valve gear and/or slide valve gear. The size of the orifice flow cross-section area corresponds to the sum of flow cross-sectional areas around and inside the annular plate. A space is provided in an interior area adjacent to the valve seat for a spark plug and/or an injection nozzle.

19 Claims, 6 Drawing Sheets

B

CYLINDER HEAD FOR A FOUR STROKE COMBUSTION ENGINE

TECHNICAL FIELD

This invention relates to a cylinder head of four stroke piston combustion engines with a valve gear mechanism including lifting valves for each cylinder, especially to the arrangement of the conduits and valve gear elements in the cylinder head.

BACKGROUND OF THE INVENTION

From the present state of engineering it is known that lifting valves are the most suitable valve arrangement for a four stroke engine. So far the best valve arrangement in the engine head is the multiple valve, mostly four valve arrangement. By this valve arrangement a part of the head surface is taken up by inlet valves and part by exhaust valves. The passage through the conduits and around the valves has a major influence on the engine characteristics. The cylinder head with inlet and exhaust valves in modern four stroke engines is at the limit of passage capacity and further considerable increase cannot be attained.

The idea of using the cylinder head surface for a common main conduit for inlet and exhaust from the cylinder has been known for a long time. This arrangement enables, theoretically, a considerable increase of passage capacity in the cylinder heads. The cross section of the main conduit may utilize up to 40% of the cylinder cross section. But this brings a number of problems. For instance, a common main conduit requires further valve gear components for the inlet and exhaust conduits and fitting these components to the main conduit, a greater mass and a large stroke necessary for the common lifting valve. Locating the spark plug or jet injection nozzle may cause problems. But the main problems are the aerodynamic properties of the main conduit in head and the passage around the valve. The design of the main conduit and lifting valve for inlet and exhaust of the cylinder also causes a number of problems.

GB patent GB-A-230 644 disclosed improvements in or relating to the valves of internal combustion engines of the diesel type. In a diesel internal combustion engine, the combination of a mechanically operated annular valve or group of simultaneously operated valves arranged in an annular manner, the valve or group of valves are adapted to operate both for air admission and exhaust. A central projection or head on which an inner edge of the annular valve is seated or which lies in the center of the group of valves, and a mechanically operated fuel valve is located in said projection or head.

The final features of known designs are, in general, worse than the contemporary multi valve cylinder heads.

SUMMARY OF THE INVENTION

The above-mentioned deficiencies are eliminated by a cylinder head of a four-stroke combustion engine with a valve gear with lifting valves in accordance with the invention, in which at least one inlet conduit provided with a valve and/or slide valve and at least one exhaust conduit situated in the cylinder head connect into a single main conduit. The main conduit has an orifice having the shape of an annulus, the axis of which is aligned with the main axis of the cylinder. The orifice of the main conduit is provided with an interior valve seat and an exterior valve seat, on which, in the closed position, is seated an annular, that is, ring-shaped, plate of the sole lifting valve. The exhaust conduit of the cylinder head is directly interconnected to the exhaust branch and includes no valve gear and/or slide valve gear. The size of the orifice flow cross-section area corresponds to the sum of flow cross-sectional areas around and inside the annular plate. In addition, a ratio of an inside diameter $d_{1v}$ of the annular plate to an outside diameter $d_{2v}$ of the annular plate corresponds to the ratio of the flow cross-sectional area inside the annular plate to the flow cross-sectional area outside the annular plate. The lifting valve is provided with at least one stem. A space is provided in an interior area adjacent to the valve seat in which is disposed a sparking plug and/or an injection nozzle.

The sealing surfaces of the inside valve seat and the outside valve seat are preferably placed on a single flat or conical surface. The lifting valve may be provided with only one valve stem positioned on the conduit axis. The stem is connected to the annular plate by at least one bridge and individual sealing means seal the stem in the cylinder head of the combustion engine. The lifting valve may also be provided with two stems situated in the orifice of the main conduit. The stems are, in this case, connected to the annular plate at 180° about the circumference of the plate relative to one another. All stems may be arranged in one line one after the other. It is advantageous to govern them by a simple cam shaft.

In the combustion engine inlet part a non-return lamellar valve or a rotating slide valve may be placed.

The exhaust conduit may be terminated on an opposite side of cylinder head than the inlet conduit while the axis of the inlet conduit and/or the axis of exhaust conduit do not cross the axis of the cylinder.

The inlet conduit and exhaust conduit may be terminated on the same side of the cylinder head while the axis of the inlet conduit and/or the axis of the exhaust conduit do not cross the axis of the cylinder.

The exhaust branches of each engine cylinder are preferably interconnected with ejector joints.

In the orifice of the main conduit may be placed a low pressure fuel injection means for the delivery of fuel directly into the cylinder space. The head may be provided with a collar to maintain a shape transition from the outer valve seat to the cylinder wall. The collar may form a part of the head gasket.

The inlet conduit may end on the same or on the opposite side of the cylinder head compared with the exhaust conduit. The inlet and exhaust conduits may be formed out of parallel to obtain a turbulent flow effect.

In the cylinder head is, according to the invention, appropriately placed a single main conduit of a large flow cross-section, which is divided into an inlet conduit and an exhaust conduit. The annular shape of the main conduit and the annular shape of the ring plate of the lifting valve ensure very good utilization of the main conduit cross-section and a uniform by-passing of the lifting valve with a minimum of unwanted turbulence. The shape and dimensions of the lifting valve also ensure a sufficiently large flow cross-section on the outer and inner perimeter of the annular plate. All this leads to a considerable raising of the operating parameters of the cylinder head. By this a higher efficiency, higher turnings and output of the combustion engine may be achieved.

The shape of the main conduit orifice also enables the shaping of the inlet conduit and the main conduit for a purposeful turbulence in the intaken gas flow around the cylinder axis while maintaining a sufficient gas inlet flow into the cylinder. This is advantageous for the improvement of efficiency and combustion ecology.

The shape of the lifting valve and its positioning enables a favourable shaping of the combustion chamber and suitable location of the spark plug or injection nozzle.

From the point of view of the heat lead on the lifting valve and seats, it is advantageous that the lifting valve actuates the exhaust and inlet of gas into the cylinder. The inlet and exhaust system of a four stroke engine equipped with a cylinder head according to this invention must be designed for a thorough scavenging of the main conduit at the end of the exhaust stroke. This may cause certain problems especially with engines charged at atmospheric pressure. On these engines it is advantageous to use a lamellar non-return valve in the inlet conduit and in the exhaust manifold to use an ejector combination of the branches. The advantage of scavenging the main conduit is that it allows for cooling of the exposed cylinder head parts, the lifting valve, valve seats and other parts.

The injector delivers fuel directly into the cylinder through the space created by opening the lifting valve. This arrangement is advantageous from the ecological view as the fuel does not form deposits on the conduit walls in the cylinder head.

The cylinder head according to the invention is a solution which includes some elements not currently used in contemporary cylinder head designs. But all these elements can be technically solved. Advantages and especially the prospect of further development of four stroke combustion engines should compensate the development expenses and effort.

BRIEF DESCRIPTION OF THE DRAWINGS

The cylinder head, according to the invention, will be described in more detail by individual examples shown on the following illustrations, where.

DETAILED DESCRIPTION

Figure 1:
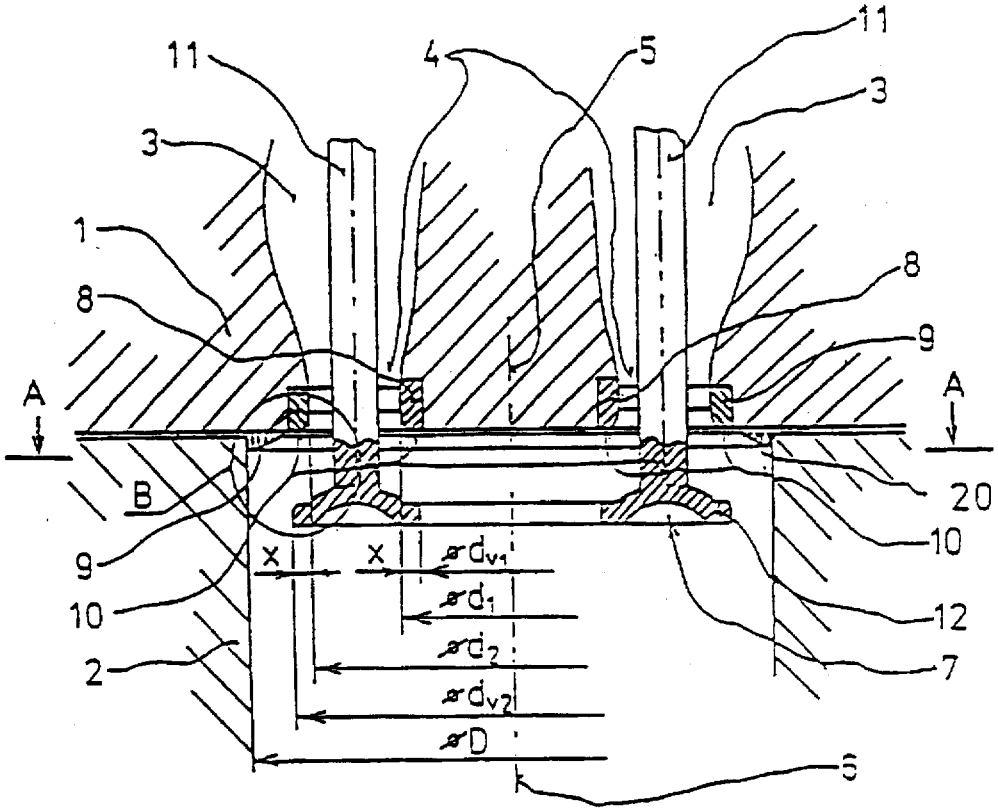
FIG. 1 is a front sectional view of the cylinder head part with the main conduit and a lifting valve with two stems according to the invention, In FIG. 1 the main dimensions of the lifting valve, main conduit and engine cylinder are marked.
Figure 2:
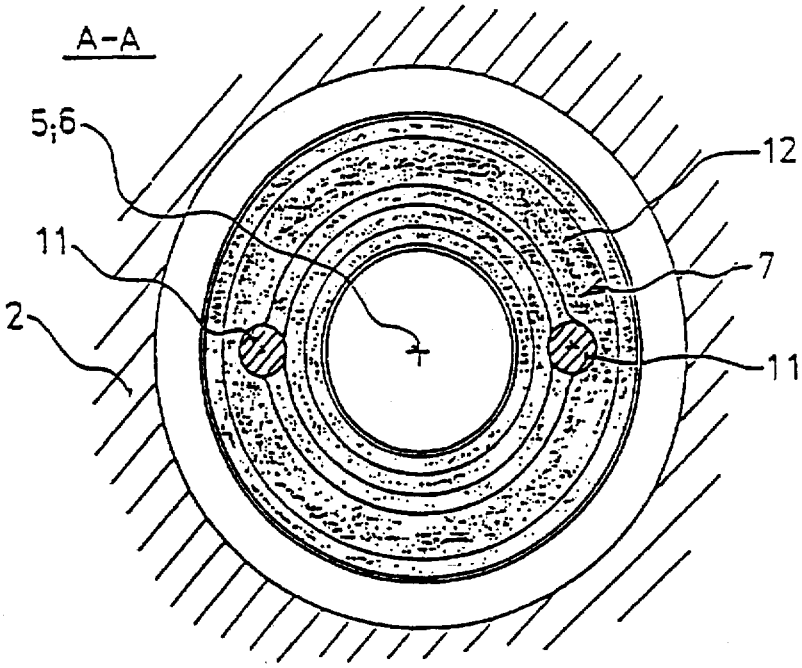
FIG. 2 shows a plan part view of the cylinder head of FIG. 1.
Figure 3:
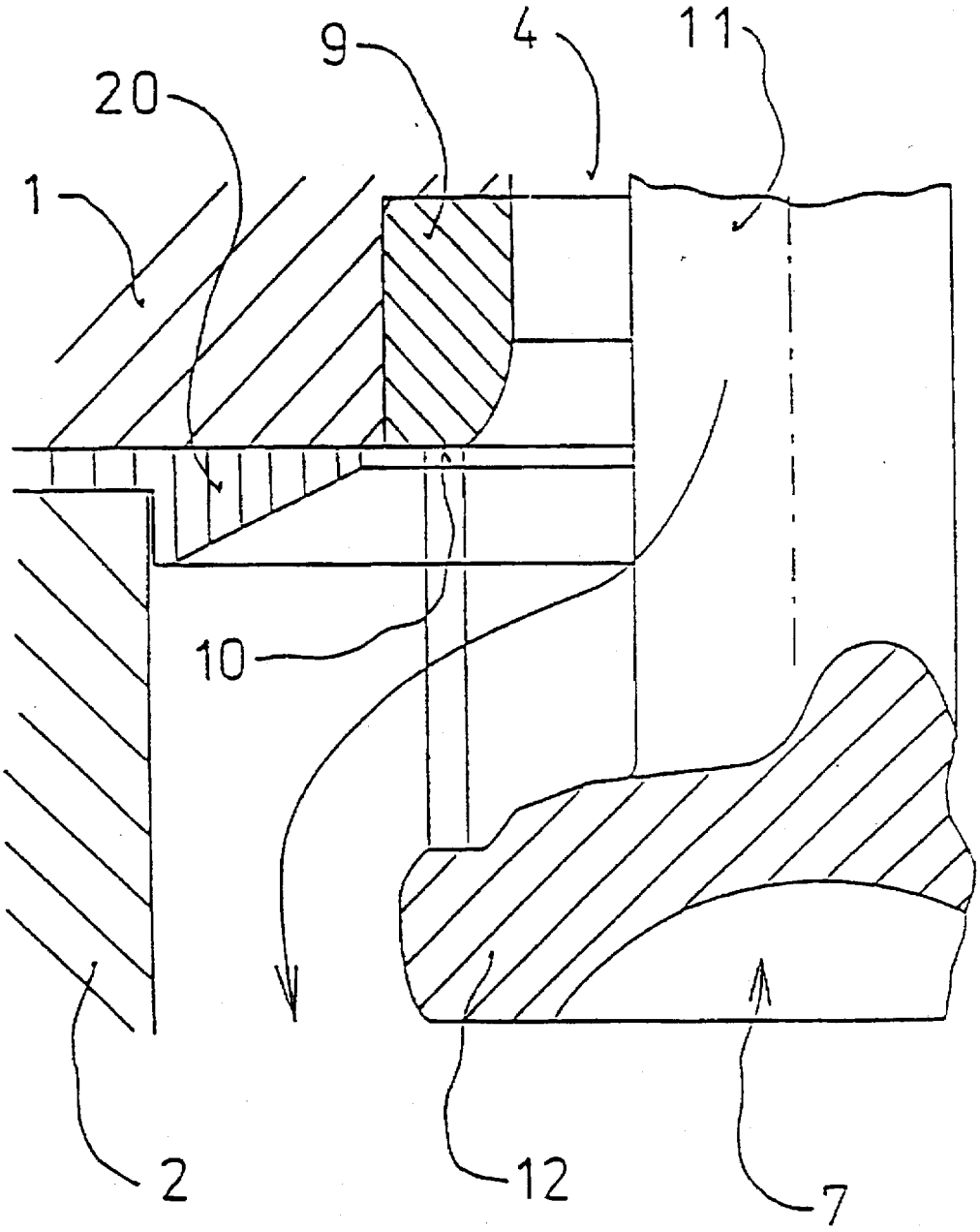
FIG. 3 shows an enlarged detail of the lifting valve and of the valve seat shown in FIG. 1.

The model head 1 of cylinder 2 of a four stroke combustion engine equipped with a valve gear with lifting valves 7 in the head 1 of cylinder 2, is shown in FIG. 1. The cylinder head is formed with a main conduit 3, which has an orifice 4 leading into the cylinder 2. The orifice 4 is formed with an annular cross-section. The axis 5 of the orifice 4 is situated to coincide with an axis 6 of the cylinder 2. In the orifice 4 of the main conduit 3 is disposed the interior valve seat 8 and exterior valve seat 9 with their sealing surfaces 10 situated on one level. A single lifting valve 7 includes an annular plate 12 disposed in the cylinder 2. The annular plate 12 has a closed position in which it seals on the interior valve seat 8 and exterior valve seat 9. This lifting valve 7 is provided with two stems 11 extending through the orifice 4 and these stems 11 are connected to on the annular plate 12, and situated relative to one another at 180°. FIG. 1 shows also the main dimensions of the orifice 4, the lifting valve 7 and the cylinder 2. For $d_1$ and $d_2$ the following derived formulas are accurate.

$$d_1 = 1/3x + \frac{1}{6}\sqrt{4x^2 + 6D^2}\ ;\ d_2 = \frac{(D^2 - 2d_1^2)}{2d_1}$$

Where D is given and the dimension x must be suitably chosen. D is the diameter of the cylinder 2, $d_1$ is the inside diameter of the main conduit 3 and $d_2$ is the outside diameter of main conduit 3. $d_{1v}$ is the inside diameter of annular plate 12 and $d_{2v}$ is the outside diameter of annular plate 12. The sealing surface 10 of the exterior valve seat is shown in FIG. 3.

Figure 4:
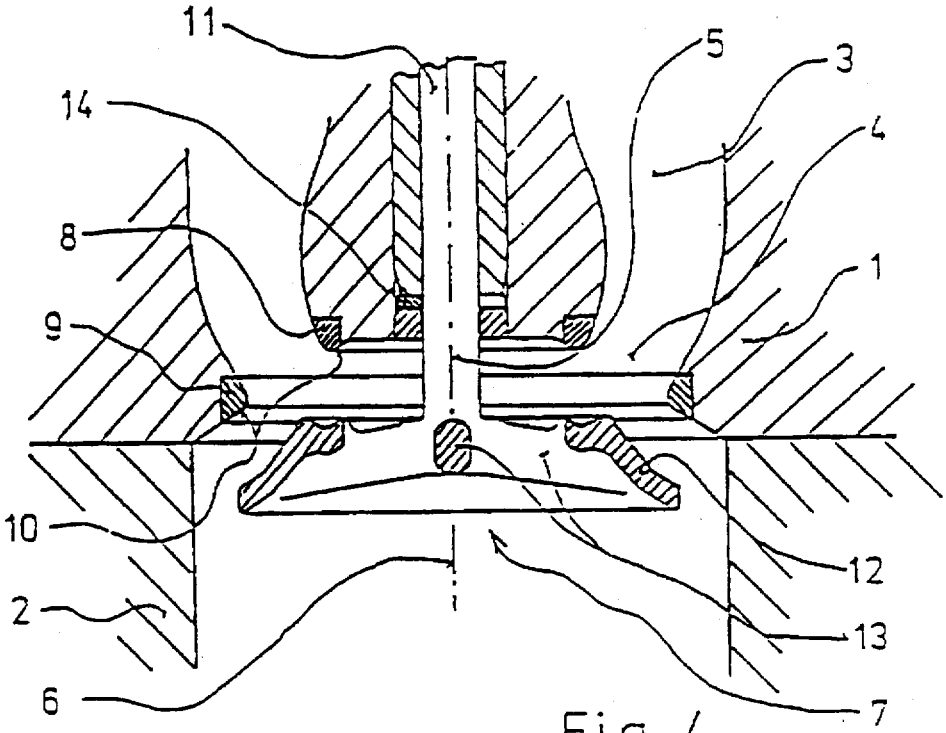
FIG. 4 is a sectional view of a cylinder head with the main conduit and lifting valve provided with one stem.
Figure 5:
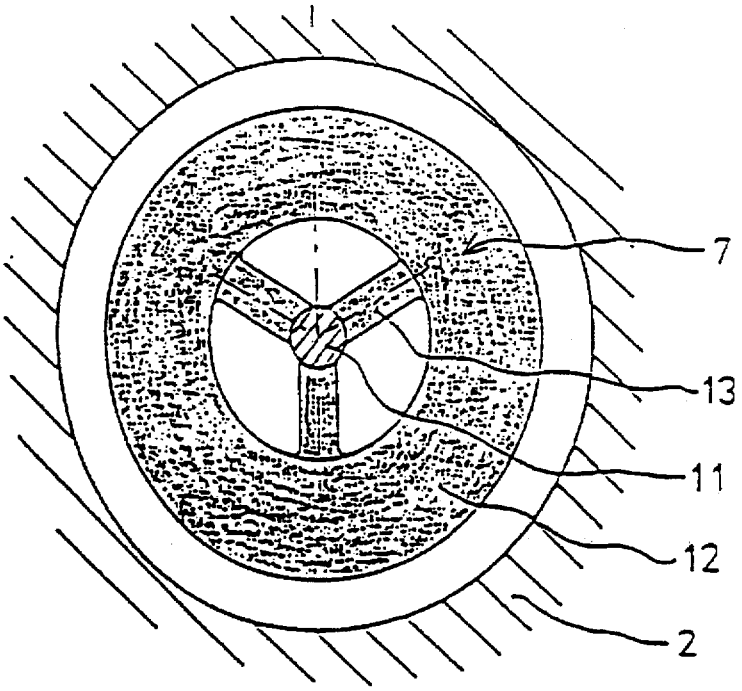
FIG. 5 shows a plan part view of the cylinder head of FIG. 4.

In another possible arrangement of head 1, according to FIG. 4, the sealing surfaces 10 of the interior valve seat 8 and the exterior valve seat 9 are arranged so that they are situated on one conical surface. The lifting valve 7 is provided with a single stem 11 aligned on the axis 5 of the orifice 4 and on the axis 6 of the cylinder 2. This stem 11 is connected to the annular plate 12 by three bridges 13 and is provided with sealing means 14 to seal the stem in the cylinder head.

Figure 6:
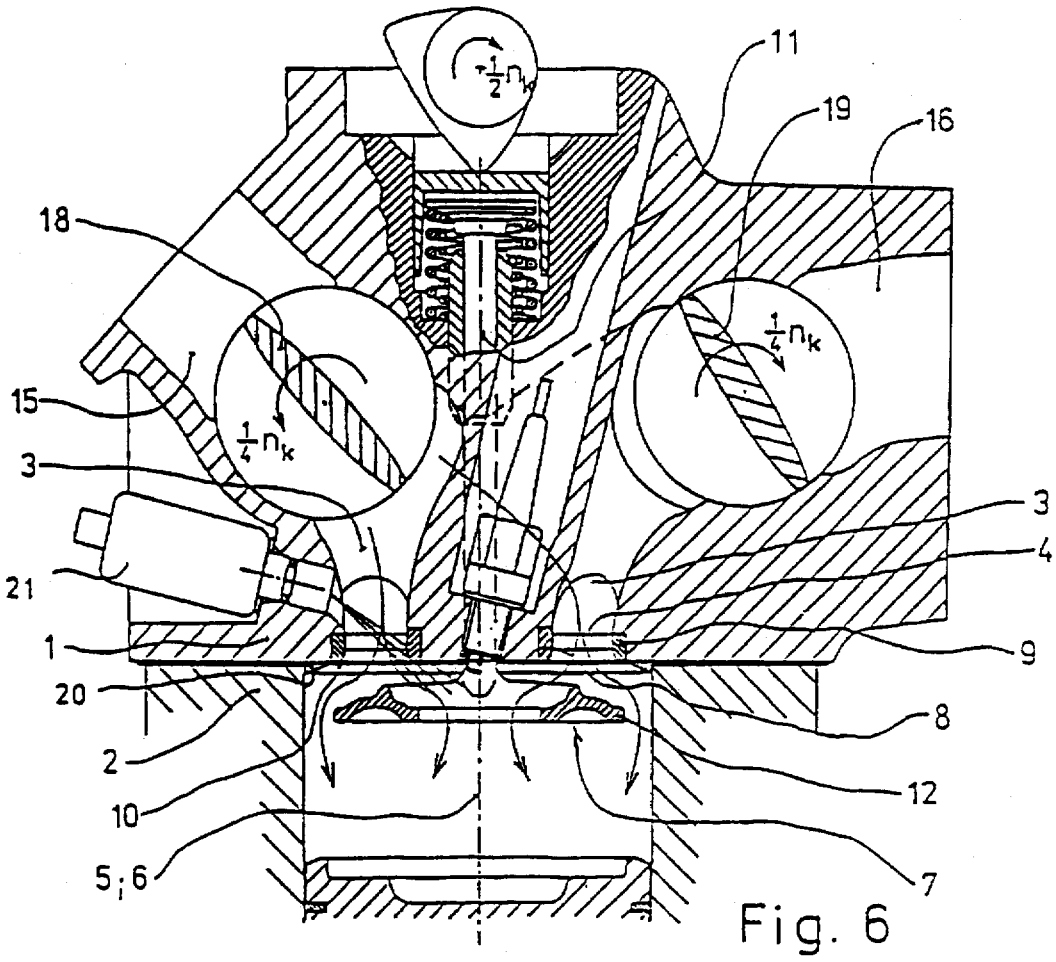
FIG. 6 is a sectional view of a cylinder head in accordance with the invention having a rotary slide valve in the inlet conduit and exhaust conduit.
Figure 7:
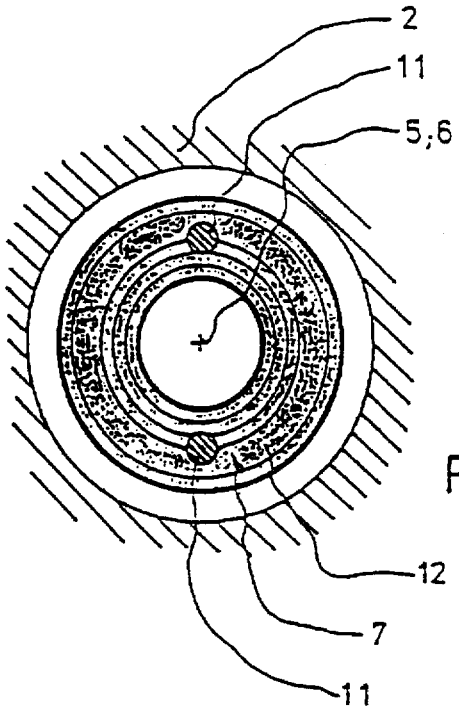
FIG. 7 is a plan view of the cylinder head of FIG. 6.

The embodiment of the cylinder head 1 shown in FIG. 6 is based on the embodiment according to FIG. 1. The main conduit 3 is branched into inlet conduit 15 and exhaust conduit 16. The inlet conduit 15 is provided with a rotating slide valve 18 whose revolutions equal to ¼ of engine shaft revolutions.

Figure 8:
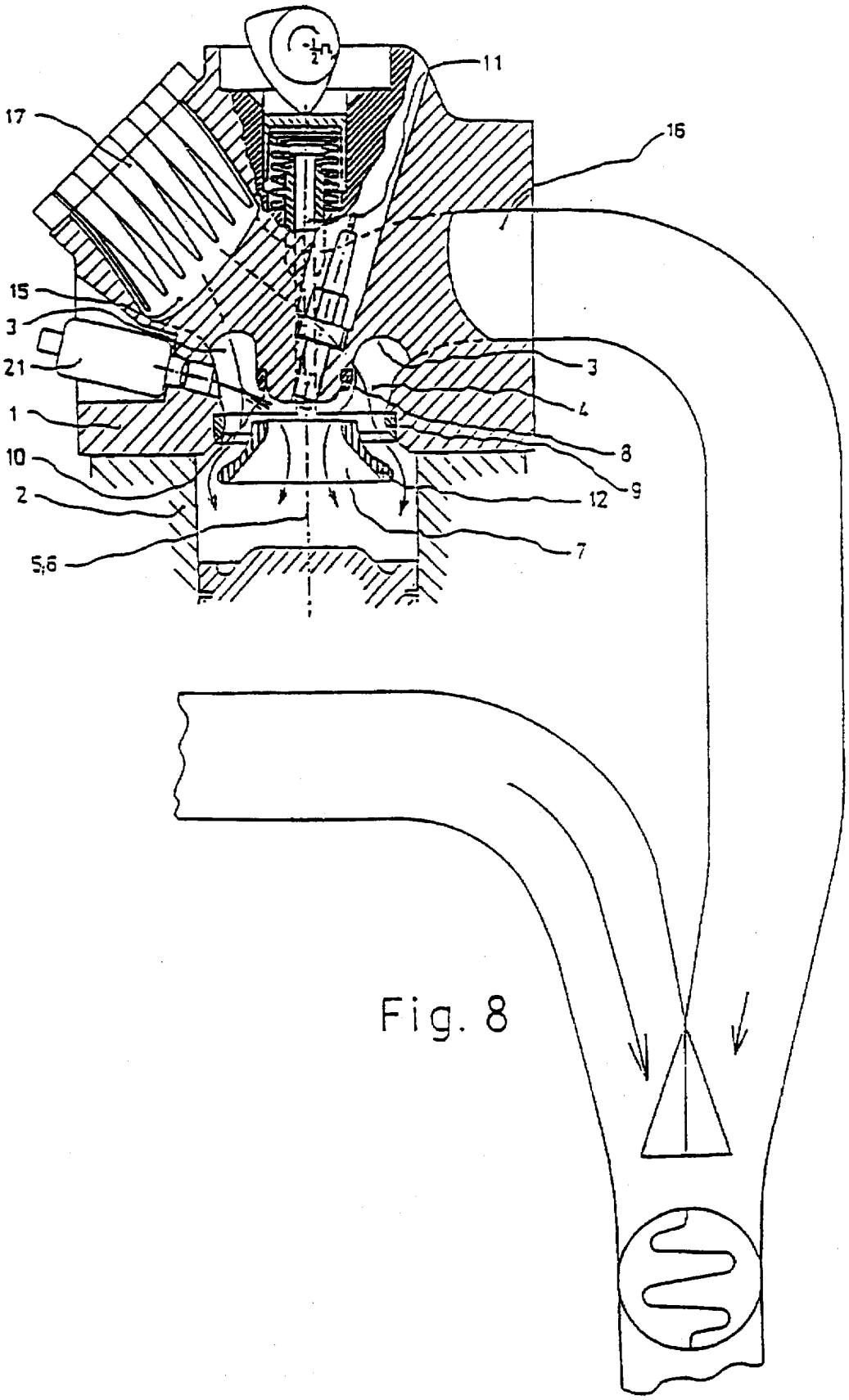
FIG. 8 shows a front sectional view of the cylinder head of a four stroke engine with a non-return lamellar valve in the inlet conduit and a portion of an exhaust manifold adjoining the exhaust port in the head.

The embodiment of the cylinder head 1 according to FIG. 8, is based on the cylinder head of FIG. 4. According to FIG. 8, in the inlet conduit 15, the rotating slide valve 18 is replaced by a non-return lamellar valve 17 and the sealing surfaces 10 for the lifting valve 7 are provided on one conical surface.

Figure 9:
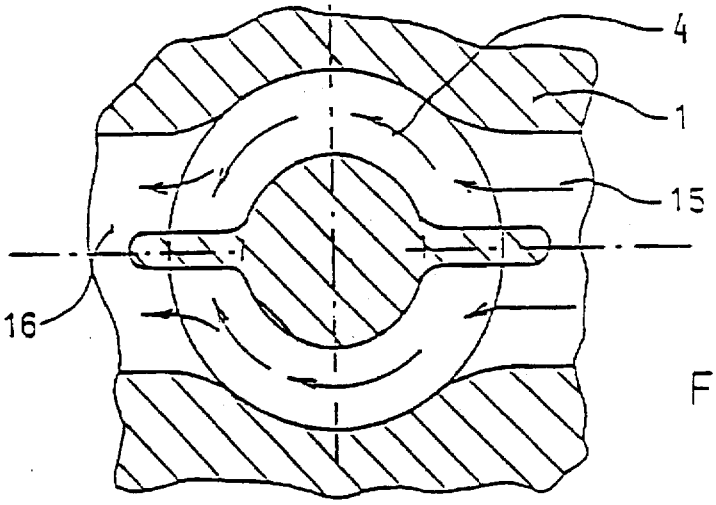
FIG. 9 shows a plan view of pan of a cylinder head with symmetrically spaced conduits, where the exhaust conduit outlet from the cylinder head is on the opposite side to the inlet conduit.
Figure 10:
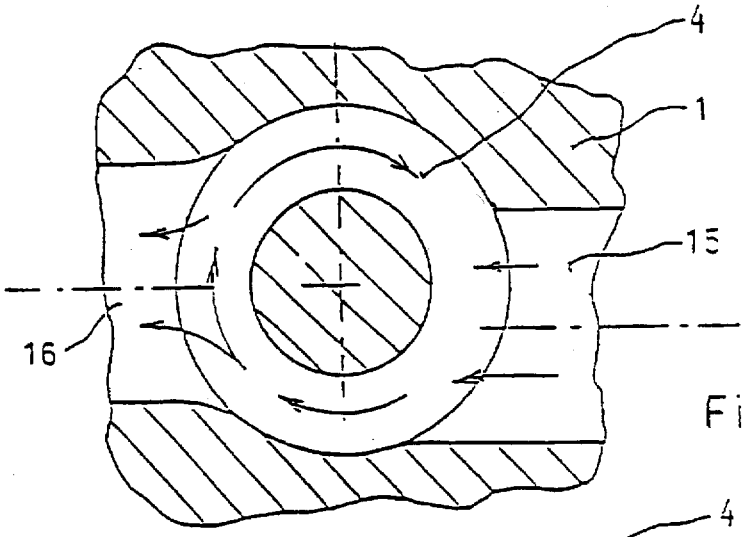
FIG. 10 shows a plan view of a cylinder head with an inlet conduit out of parallel and leading to the opposite side compared to the exhaust conduit.
Figure 11:
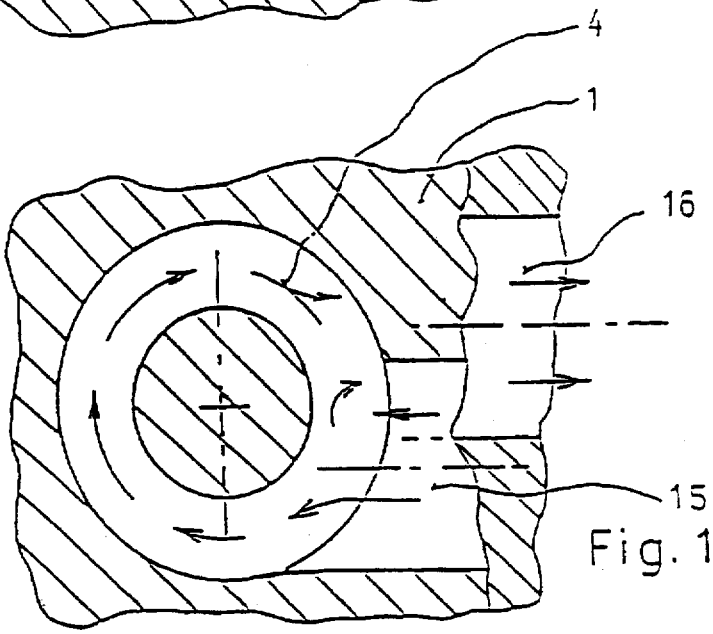
FIG. 11 shows a plan view of the cylinder head with inlet and exhaust conduits outlets leading to the same side of head.

In all the described embodiments, it is possible to place the inlet conduit 15 and exhaust conduit 16 in the head 1 of cylinder 2 according to FIG. 9, 10 or 11. According to FIG. 9, a symmetrical inlet conduit 15 and exhaust conduit 16 are formed, with the inlet conduit 15 communicating on the opposite side of head 1 than the exhaust conduit 16.

The embodiment according to FIG. 10 differs from the embodiment according to FIG. 9 only by the inlet conduit 15 being positioned out of axial alignment for the creation of a turbulence effect.

In the embodiment according to FIG. 11, both the inlet conduit 15 and exhaust conduit 16 lead to the same side of head 1 of cylinder 2 and are positioned out of axial alignment.

The lifting valve 7 in the head 1 of cylinder 2 opens and closes the orifice 4 of the main conduit 3 leading to the cylinder 2.

At the beginning of the exhaust stroke the lifting valve 7 is opened. In the main conduit 3 the inlet conduit 15 is closed by the rotating slide valve 18 or by a non-return valve 17. The flow of exhaust gases from the cylinder 2 into the exhaust conduit 16 then begins. At the end of the exhaust stroke the lifting valve 7 may stay open or be closed. In the inlet conduit 15 the rotating slide valve 18 or the non-return valve 17 is opened. Scavenging of the main conduit 3 space by clean air from the inlet conduit 15 then occurs. Lifting valve 7 is open or is then opened and the cylinder 2 is filled. Further activity is similar to procedures for conventional four stroke engines. For the correct functioning of the engine a thorough scavenging of the main conduit 3 in head 1 at the end of the exhaust stroke is necessary. From this point of view the use of a lamellar non-return valve 17 is an advantage, because it opens automatically and quickly to a large flow cross-section and makes full use of the exhaust gases inertia for the scavenging of the main conduit 3 space. For this purpose it is necessary to provide the exhaust conduit with ejector joints of the exhaust branches of each engine cylinder 2. In a supercharged engine effective scavenging of main conduit 3 is no great problem.

Industrial applicability

The cylinder head described in the invention may be used with most types of four stroke engines.

We claim:

1. A head of a four stroke combustion engine having a valve gear with lifting valves comprising:

a head of a cylinder having at least one inlet conduit and at least one exhaust conduit;

a single main conduit connecting the at least one inlet conduit and the at least one exhaust conduit to a cylinder, the main conduit having a cross-section in the shape of an annulus, an axis of the main conduit being aligned with an axis of the cylinder;

an inlet conduit valve;

the main conduit having an orifice connecting the main conduit to an interior space of the cylinder, the orifice having an interior valve seat and an exterior valve seat;

a sole lifting valve having an annular plate, the lifting valve having a closed position in which the annular plate is situated in the orifice.

2. A cylinder head according to claim 1, wherein the annular plate defines an inner flow area within an inside diameter of the plate and an outer flow area between an outside diameter of the plate and an inner surface of the cylinder, and wherein the orifice has a flow cross-sectional area substantially equal to a sum of the inner and outer flow areas defined by the annular plate and wherein a ratio of the inside diameter of the annular plate to the outside diameter of the annular plate corresponds to a ratio of the inner flow area of the annular plate to the outer flow area of the annular plate, wherein the flow areas lie in a plane normal to the axis of the cylinder.

3. A cylinder head according to claim 1, wherein the lifting valve in the closed position is in contact with sealing surfaces of the interior valve seat and the exterior valve seat which sealing surfaces are situated on a single flat or conical surface.

4. A cylinder head according to claim 1, wherein the lifting valve is provided with a single stem placed along the axis of main conduit, the stem is connected to the annular plate by at least one bridge, and wherein a sealing member seals the stem in the head of the cylinder.

5. A cylinder head according to claim 1, wherein the lifting valve is provided with two stems situated in the orifice of the main conduit, the stems are connected to the annular plate and situated at 180° relative to one another, and wherein the stems are situated in one row in the head.

6. A cylinder head according to claim 1, wherein the inlet conduit valve of the combustion engine head is an automatic and non-return valve.

7. A cylinder head according to claim 1, further comprising a slide valve disposed in the exhaust conduit of the combustion engine head.

8. A cylinder head according to claim 1, further comprising a fuel injector disposed adjacent the orifice of the main conduit for low pressure fuel injection directly into the interior space of the cylinder.

9. A cylinder head according to claim 1, wherein the exhaust conduit terminates on an opposite side of the head from the inlet conduit and wherein an axis of one of the inlet conduit and the exhaust conduit does not cross the axis of the cylinder.

10. A cylinder head according to claim 1, wherein the inlet conduit and the exhaust conduit terminate on one side of the head and an axis of one of the inlet conduit and the exhaust conduit does not cross the axis of the cylinder.

11. A cylinder head according to claim 1, wherein the inlet conduit valve is a slide valve.

12. A cylinder head of a four stroke combustion engine with a valve gear with lifting valves, comprising:

a cylinder head having at least one inlet conduit provided with a valve and at least one exhaust conduit joining into a single main conduit, the main conduit having an orifice opening into a cylinder, the orifice having a cross-section in the shape of an annulus, an axis of the orifice being aligned with a main axis of the cylinder and the orifice of the main conduit being provided with an interior valve seat and an exterior valve seat, a sole lifting valve having an annular plate disposed in the cylinder, the lifting valve having a closed position in which the annular plate is seated on the interior valve seat and the exterior valve seat, wherein the exhaust conduit of the cylinder head is directly interconnected to an exhaust branch and provided without any valve gear, where the orifice defines a flow cross-sectional area is substantially equal to a sum of an outer flow cross-sectional area defined between an outside diameter $d_{2v}$ of the annular plate and an inner surface of the cylinder and an inner flow cross-sectional area defined within an inside diameter $d_{1v}$ of the annular plate and wherein a ratio of the inside diameter $d_{1v}$ of the annular plate to the outside diameter $d_{2v}$ of the annular plate is substantially equal to a ratio of the inner flow cross-sectional area to the outer flow cross-sectional area, wherein the lifting valve is provided with at least one stem and wherein the cylinder head includes a space adjacent the interior valve seat, at least one of a sparking plug and an injection nozzle being disposed in the space.

13. A cylinder head according to claim 12, wherein the lifting valve in the closed position is in contact with the sealing surfaces of the interior valve seat and exterior valve seat which are situated on a single flat or conical surface.

14. A cylinder head according to claim 12, wherein the lifting valve is provided with a single stem placed along an axis of the main conduit, and wherein the stem is connected to the annular plate by at least one bridge and the stem is provided with individual sealing means in the cylinder head of the combustion engine.

15. A cylinder head according to claim 12, wherein the lifting valve is provided with two stems situated in the orifice of the main conduit, and wherein the stems are connected to the annular plate and situated on the annular plate 180° relative to one another, and wherein the stems are disposed in one row behind each other in the cylinder head.

16. A cylinder head according to claim 12, wherein the valve in the inlet conduit of the combustion engine cylinder head is an automatic and non-return valve.

17. A cylinder head according to claim 12, further comprising a fuel injector mounted in the orifice of the main conduit for low pressure fuel delivery directly into the cylinder.

18. A cylinder head according to claim 12, wherein the exhaust conduit connects on an opposite side of the cylinder head than the inlet conduit and an axis of one of the inlet conduit and the exhaust conduit does not cross the axis of the cylinder.

19. A cylinder head according to claim 12, wherein the inlet conduit and exhaust conduit terminate on one side of the cylinder head and an axis of one of the inlet conduit and the exhaust conduit does not cross axis of cylinder.

* * * * *